US005947187A

United States Patent [19]

Blohowiak et al.

[11] Patent Number: 5,947,187

[45] Date of Patent: Sep. 7, 1999

[54] METHOD FOR PROTECTING A DIE

[75] Inventors: Kay Y. Blohowiak; Charles W. Newquist, both of Issaquah, Wash.

[73] Assignee: The Boeing Company, Seattle, Wash.

[21] Appl. No.: 08/963,309

[22] Filed: Aug. 18, 1997

Related U.S. Application Data

[62] Division of application No. 08/406,825, Mar. 20, 1995, which is a continuation of application No. 08/184,124, Jan. 21, 1994, abandoned.

[51] Int. Cl.[6] ..... B22C 1/02

[52] U.S. Cl. ..... 164/519; 427/312.2; 164/20; 164/576; 164/518

[58] Field of Search ..... 427/135, 376.2, 427/376.1, 372.2; 164/20, 516, 518, 519

[56] References Cited

U.S. PATENT DOCUMENTS

| | | | |
|---|---|---|---|
| 3,934,441 | 1/1976 | Hamilton et al. . | |
| 4,040,845 | 8/1977 | Richerson et al. . | |
| 4,106,915 | 8/1978 | Kagawa et al. . | |
| 4,146,769 | 3/1979 | Fegin | 249/134 |
| 4,269,053 | 5/1981 | Agrawal et al. . | |
| 4,328,285 | 5/1982 | Siemers et al. . | |
| 4,358,544 | 11/1982 | Skedgell . | |
| 4,732,719 | 3/1988 | Panda et al. . | |
| 4,740,246 | 4/1988 | Feagin . | |
| 4,889,548 | 12/1989 | Kriegesmann et al. | 65/305 |
| 4,956,008 | 9/1990 | McQuilkin . | |
| 5,085,720 | 2/1992 | Mikeska et al. | 156/89 |
| 5,094,687 | 3/1992 | Elepano . | |
| 5,122,317 | 6/1992 | Chen et al. . | |
| 5,221,336 | 6/1993 | Horton . | |
| 5,389,352 | 2/1995 | Wang . | |

FOREIGN PATENT DOCUMENTS

| | | |
|---|---|---|
| 38716 | 1/1991 | Japan . |

*Primary Examiner*—Archene Turner
*Attorney, Agent, or Firm*—John C. Hammar

[57] ABSTRACT

Ceria is used to assure release between a metal workpiece and associated forming tooling in forming operations conducted at temperatures of 1500° F. (816° C.) and above.

10 Claims, No Drawings

METHOD FOR PROTECTING A DIE

REFERENCE TO RELATED APPLICATIONS

The present application is a divisional application based upon U.S. patent application Ser. No. 08/406,825, filed Mar. 20, 1995 pending, which was a continuation application based upon U.S. patent application Ser. No. 08/184,124, filed Jan. 21, 1994 now abandoned.

TECHNICAL FIELD

The present invention relates to a release agent particularly preferred for use in hot forming and SPF operations using ceramic dies at temperatures of about 1500° F. (816° C.) to above 1850° F. (1110° C.). Ceria is applied in powder or liquid dispersion form to the die surface and is applied in a liquid dispersion form to the metal worksheet.

BACKGROUND ART

Boron nitride commonly is used as a release agent or stop-off in many forming operations. Sometimes boron nitride is used in conjunction with other release coatings to ensure that the worksheets being formed can be separated from the dies. For example, Agrawal et al. U.S. Pat. No. 4,269,053 (issued May 26, 1981) describes using release coatings of two different coefficients of friction in SPF operations. Agrawal teaches using boron nitride and yttria as the two preferred release agents so that the workpieces of"reactive" metals like titanium or zirconium do not react with the metal of the forming member (i.e., die). Agrawal discusses that single release coatings of yttria, boron nitride, graphite, or alumina in an organic binder applied by spraying or silk screening are often used in SPF operations. Yttria alone results in a non-uniform thickness in the cup portion of the formed product. Boron nitride alone produces local necking in the radius area. Agrawal overcomes these problems by applying yttria to the areas of the preform (i.e., the worksheet(s)) which undergo little or no expansion while boron nitride is applied in the areas which undergo extensive expansion. Typically, Agrawal applies the release coatings directly to the die, but may apply it to the preform to reduce disruption of the loading of the SPF presses. Applying the coatings to the preform, however, increases the importance of proper preform placement in the die.

While boron nitride can effectively be used in SPF titanium operations using metal dies because the dies have near-zero porosity to eliminate damaging oxidation of the boron nitride above 1500° F. (816° C.), it is not as effective with ceramic dies. Ceramic dies, have inherent porosity that allows sufficient air to oxidize the boron nitride to boria (i.e., $B_2O_3$) glass which will bond the titanium worksheet to the ceramic die surface, ruining both the workpiece and the dies. Therefore, with hot forming and SPF of metals in ceramic dies, boron nitride is an ineffective release agent whose use must be avoided.

SUMMARY OF THE INVENTION

The present invention uses ceria as the release agent in high temperature forming operations prone to oxidation where conventional release agents are ineffective. In particular, we use ceria as a release agent for hot forming and SPF operations for titanium or other metals in ceramic dies at temperatures above about 1500° F. (816° C.) where boron nitride would oxidize to destructive boria. The ceria (i.e. cerium oxide) is applied in a thin, uniform coating to the worksheet by spraying ceria dispersed in water or another suitable carrier with a small amount of a binder. Typically the ceria is in powder form and the binder is an acrylic emulsion or another organic binder. The ceria also preferably is applied in powder or dispersion form to the contact faces of the ceramic die. In this way, we easily overcome the deficiencies of prior art release agents when conducting these high temperature operations.

BEST MODE CONTEMPLATED FOR MAKING AND USING THE INVENTION

A number of metals, for example, alloys of titanium and zirconium, exhibit the property of developing unusually high tensile elongation with a reduced tendency toward local necking during deformation at elevated temperatures. This property is called superplasticity. Typically, superplastic forming ("SPF") of structures is accomplished by heating a preform or workpiece to a range Where it exhibits superplasticity and expanding portions of the preform against the surface of a forming member having a shape complimentary to that of the desired final part. This process is discussed in detail in U.S. Pat. No. 3,934,441, "Controlled Environment Superplastic Forming of Metals," by C. H. Hamilton, et al. The combining of superplastic forming with diffusion bonding is fully discussed in U.S. Pat. No. 3,927,817, "Method for Making Metallic Sandwich Structure," by C. H. Hamilton, et al. These patents are incorporated by reference and thus a detailed discussion of the processes is unnecessary. The present invention relates to an improvement to the SPF process.

While SPF traditionally has used metal dies, the trend today is toward ceramic dies, especially with today's emphasis toward lean manufacturing techniques and rate adaptive manufacturing where a workcell will be used to make many different parts at low rates of production. The switch to ceramic dies introduced new challenges to SPF. The present invention focuses on one of the most critical challenges, releasability of the workpiece and die. Ceria coatings provide a simple, reliable, inexpensive solution.

SPF ceramic dies commonly are made from calcium aluminate cements that can also include fused silica grains, microcrystalline silica, and/or silicon carbide. These ceramic dies are inherently porous. Therefore, an improved release agent is required to permit their use in SPF titanium prototyping or limited production.

Hot forming involves heating the metal workpiece prior to working, drawing, or otherwise forming the heated workpiece to the desired shape. The working in this case is outside the SPF domain. Typical temperatures for hot forming titantium or titanium alloys are about 1500° F. (816° C.) up to the SPF temperature. Hot forming is an alternative to SPF with differing design and processing constraints.

Ceria ($CeO_2$) is a desirable release agent for these applications for many reasons. First, ceria is thermochemically stable at the temperatures of use (generally 1500° F. to above 1850° F.). It will not reduce in the low oxygen partial pressure environment as many other oxides do in the presence of titanium, with the concomitant formation of titania (i.e., titanium oxide). Second, ceria forms neither compounds nor eutectic compositions with either the titanium workpiece or the ceramic die constituents. Third, ceria does not sinter at the use temperature, so the ceria remains in a fine particulate form. Fourth, ceria is naturally colored differently from the natural color of the die so that its presence is readily identifiable on the white or gray surface of the ceramic die. In addition, it is easier to tell whether a complete coating on the die has been created. Fifth, ceria is readily available because it is used as a final polishing material in the grinding of glass optics or polishing of gemstones. Sixth, ceria is softer than other high temperature oxide materials which may contribute to the ease of separating the workpiece from the die because the softness may induce sliding when the ceria yields. Seventh, ceria is not considered hazardous or toxic in normal industrial handling. We believe these combinations of properties are unique for ceria and that they make ceria uniquely suited to be a release agent for hot forming or SPF operations using ceramic dies.

As previously discussed, the most important factors for selecting ceria is that it can withstand exposure to the high forming temperature of 1500° F. (816° C.) to above 1850° F. (1110° C.) for metal processing without degrading or reacting with either the workpiece or the die.

While described with respect to hot forming and SPF processing, ceria is a suitable release agent for other high temperature operations such as brazing which is described in copending U.S. patent application Ser. No. 08/092,050. Also, while preferred for use with ceramic dies, ceria also can be used as a release agent in high temperature operations using metal dies where it replaces boron nitride.

In ceramic die SPF operations, ceria is a suitable release agent for other high temperature SPF alloys, other than SPF titanium or SPF titanium alloys, like SPF 718 which is an SPF alloy of Inconel 718. Ceria can be used in lower temperature operations, like SPF aluminum, but is use there is not necessitated by the degradation of the commonly used boron nitride release agents.

We prefer to use reagent grade ceria powder but also achieve satisfactory results with ceria-based polishing materials.

EXAMPLE

Two hundred gm ceria powder (reagent grade) is mixed by hand with 300 gm water and 10 gm Rhoplex (an acrylic emulsion available from Rohm and Haas that commonly is used as a binder for glazes) to wet all the powder before the dispersion is mixed with a high shear mixer for about 1 minute. The well-mixed dispersion is sprayed with an airless sprayer onto both surfaces of the titanium worksheet to form a dripfree continuous layer that is dried. Three separate coats are applied.

Dry ceria power (reagent grade) is rubbed onto the contact faces of the cold ceramic die to form a continuous coating. The press is heated to about 1650° F. (900° C.) before the titanium worksheet is loaded. The worksheet is superplastically formed at about 1650° F. (900° C.). The press is opened and the completed part is removed without any bonding between the worksheet and die.

In inductive SPF, like the processes described in copending U.S. patent application Ser. Nos. 07/777,739 and 08/092,050 where the worksheet(s) are heated inductively while the die remains relatively cool, the ceria is applied to the outside surfaces of the pack (i.e., the outer inductive receptors). The pack is loaded to the cold press before the induction current is applied to heat the worksheet(s). These applications are incorporated by reference.

While we generally apply dry powder to the die surfaces, ceria may be applied by spraying or painting the slurry onto these surfaces.

A colloidal suspension of ceria can be used.

We illustrate three coating applications of ceria on the worksheet, which we prefer. More coatings can be used but apparently do not provide a benefit if care is taken to protect the worksheet surfaces after they receive three applications. We do not recommend using less than three applications.

It is possible that only either the worksheet(s) surfaces or the die faces need to be coated, but we recommend coating both to assure release.

While preferred embodiments have been described, those skilled in the art will readily recognize alterations, variations, and modifications which might be made without departing from the inventive concept. Therefore, the claims should be interpreted liberally with the support of the full range of equivalents known to those of ordinary skill based upon this description. The examples are given to illustrate the invention and not intended to limit it. Accordingly, the claims should only be limited as is necessary in view of the pertinent prior art.

We claim:

1. A method for protecting a die and a titanium or titanium alloy workpiece in a superplastic forming operation of titanium alloys at a temperature of at least about 1500° F. (816° C.), comprising the steps of:

(a) forming a release film between the die and the workpiece with powdered ceria;

(b) heating the die and workpiece to at least about 1500° F.;

(c) superplastically forming the heated workpiece;

(d) removing the formed workpiece from the die.

2. The method of claim 1 wherein the release film is formed by applying a continuous coating of an aqueous dispersion of powdered ceria with a binder on surfaces of the workpiece that contact the die, wherein the ratio of ceria to water in the dispersion is about 3:2 by weight.

3. The method of claim 2 wherein the release film also is formed by coating corresponding surfaces of the die that contact the workpiece with dry, powdered ceria.

4. The method of claim 1 wherein the release film is formed by coating surfaces of the die that contact workpiece with dry, powdered ceria.

5. The method of claim 1 wherein the release film is applied by spraying in multiple coats to form a dripfree continuous layer as a powder mixed with water and a binder to the workpiece and as a dry powder without a binder to the, die and wherein the die is porous ceramic.

6. The method of claim 5 wherein the ratio of ceria to water in the sprayed mixture is about 3:2 by weight.

7. The method of claim 6 wherein at least three coats of the sprayed mixture are applied to the workpiece.

8. An intermediate in the forming of metal part comprising (i) at least one sheet of metal forming a workpiece having die contact surfaces and (ii) a continuous coating of ceria on the contact surfaces.

9. A method for ensuring release of a workpiece from tooling during a forming operation conducted at an elevated temperature without reaction between the workpiece, tooling, or a release agent, comprising the step of:

coating the surface of the tooling that contacts the workpiece with a layer of ceria as the release agent.

10. The method of claim 9 wherein the tooling is a porous ceramic die.

* * * * *